US005975583A

United States Patent [19]

Cobben et al.

[11] Patent Number: 5,975,583

[45] Date of Patent: Nov. 2, 1999

[54] CARRIER REPRESENTING VALUE AND COMPRISING PATTERNS APPLIED BY A LASER BEAM

[75] Inventors: Johannes Ignatius Marie Cobben, Veldhoven; Arnoud Augustinus, Eersel, both of Netherlands

[73] Assignee: Industrial Automation Integrators (IAI) B.V., Veldhoven, Netherlands

[21] Appl. No.: 08/718,296

[22] PCT Filed: Mar. 29, 1995

[86] PCT No.: PCT/NL95/00119

§ 371 Date: Nov. 21, 1996

§ 102(e) Date: Nov. 21, 1996

[87] PCT Pub. No.: WO95/26274

PCT Pub. Date: Oct. 5, 1995

[30] Foreign Application Priority Data

Mar. 29, 1994 [NL] Netherlands ..... 9400498

[51] Int. Cl.[6] ..... B42D 15/10

[52] U.S. Cl. ..... 283/93; 283/57; 283/58; 283/901

[58] Field of Search ..... 283/57–59, 86, 283/94, 93, 901, 91

[56] References Cited

U.S. PATENT DOCUMENTS

| | | | |
|---|---|---|---|
| 4,939,888 | 7/1990 | Katz et al. . | |
| 4,943,093 | 7/1990 | Melling et al. | 283/91 X |
| 5,087,805 | 2/1992 | Silverschotz et al. . | |
| 5,104,149 | 4/1992 | Hoppe | 283/94 |
| 5,137,304 | 8/1992 | Silverschotz et al. | 283/56 X |
| 5,271,645 | 12/1993 | Wicker | 283/92 |
| 5,371,798 | 12/1994 | McWhortor | 283/82 X |
| 5,421,619 | 6/1995 | Dyball | 283/86 |
| 5,427,415 | 6/1995 | Chang | 283/91 X |
| 5,447,335 | 9/1995 | Haslop | 283/91 |
| 5,465,301 | 11/1995 | Jotcham et al. | 283/85 X |
| 5,468,581 | 11/1995 | Coe et al. | 283/91 X |

FOREIGN PATENT DOCUMENTS

| | | |
|---|---|---|
| 0123163 | 10/1984 | European Pat. Off. . |
| 0232502 | 8/1987 | European Pat. Off. . |
| 2365657 | 4/1978 | France . |
| 2496937 | 6/1982 | France . |
| 2496938 | 6/1982 | France . |
| 2111910 | 7/1983 | United Kingdom . |

*Primary Examiner*—Frances Han
*Attorney, Agent, or Firm*—Banner & Witcoff, Ltd.

[57] ABSTRACT

The invention relates to a carrier representing value provided with recognizable pattern, for instance in the form of giro checks, bankchecks, banknotes, shares, bonds and other documents representing a value, wherein the patterns are formed by parts treated by means of a laser beam. This object is reached in that the patterns have been provided by means of a laser light beam. The use of a laser beam makes it possible to apply particularly fine structures which either cannot be applied with other treating methods, or only with the greatest financial effort. The use of laser beams enables variation of the width or depth of the channels or perforations which is almost impossible with other treating methods.

54 Claims, 4 Drawing Sheets

CARRIER REPRESENTING VALUE AND COMPRISING PATTERNS APPLIED BY A LASER BEAM

The invention relates to a carrier representing value and comprising laser patterns provided by a laser beam which are at least partially recognisable with the eye and which have such a structure that they cannot or only with the greatest difficulties be applied on the carrier by other processes wherein the laser patterns are formed at least by parts removed by the laser beam, and patterns provided by other processes.

Such carriers representing value are generally known, for instance in the form of giro cheques, bank cheques, eurocheques, banknotes, credit cards, shares, bonds and other documents representing a value. The invention otherwise also relates to other types of documents representing a value such as passports, driving licenses and the like.

It is known problem that carriers representing value are forged and falsified. This is becoming an increasingly more significant problem. A constant attempt is made here to keep one step ahead of the forgers. In recent times the use of colour copiers has made increasingly easier forging of documents otherwise difficult to counterfeit, this in principle without too many problems.

The object of the present invention is therefore to provide steps with which carriers representing value are more difficult to forge, so that it is at least temporarily possible to remain one step ahead of the forgers.

This object is achieved in that the laser patterns and the patterns provided by other processes represent the same information.

It will be apparent that these steps make difficult the falsification of carriers representing value.

The use of a laser beam makes it possible to apply particularly fine structures which either cannot be applied with other treating methods, or only with the greatest financial effort.

The use of laser beams moreover enables variation of the width or depth of the channels or perforations, which is almost impossible with other treating methods.

Falsification is further difficult because it is almost impossible to fill in the thus resulting grooves or perforations. Should this nevertheless be achieved, it is then easy to see that there has been tampering. Laser technique furthermore offers the option of providing per se visible patterns with added, invisible patterns which can only be seen with assist means and in which information can be recorded.

The attention is drawn that the patterns are individualizable. This means, that the carriers are each on their own or each group of for instance ten carriers are provided of the same pattern. Such a situation arises for instance with bank cheques or giro cheques, which can be provided of an indication of the account number, and which can be provided with a consecutive number for each of the account numbers. Such carriers representing value are usually produced in groups of 10, 15 or 20 pieces. Of course, such carriers representing value are prepared in substantial quantities. The providing of such individualized patterns on such carriers representing value arises large problems in view of the required substantial speed of production; by the application of laser light these problems are avoided; a laser light source is indeed quickly controllable, so that each giro cheque or cheque can be provided of an individualizable pattern.

As stated before the carriers representing value can be made of paper, of plastic or of another material, for instance textile.

According to a preferred embodiment the patterns are so fine, that these can at least partially only be made visible by means of appliances.

According to another preferred embodiment the patterns are applied in the form of perforations or channels applied by a laser beam.

According to again another preferred embodiment the patterns applied to the carrier representing value are generally personalized.

The invention further relates to a device for applying individualizable recognizable patterns to carriers representing value, comprising a modulable and controllable laser light source for generating a laser beam applying patterns to the carriers representing value and control means for controlling and modulating the laser light source. The quantities for modulation are the intensity, focussing, polarization and wavelength of the laser beam.

The present invention will be elucidated hereinbelow with reference to the annexed figures, wherein.

Figure 1:
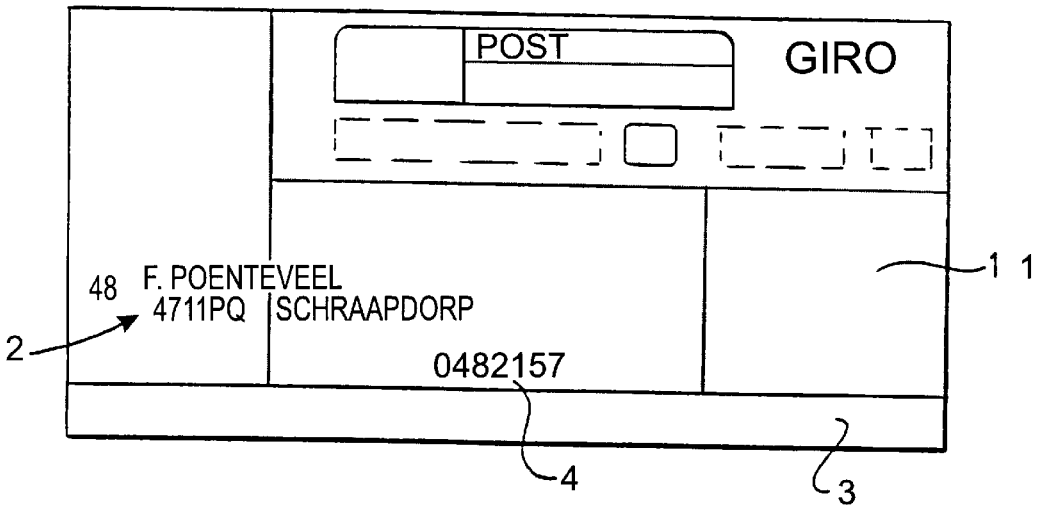
FIG. 1 shows a view of a giro cheque which is provided according to the present invention with perforations applied by a laser beam.

Shown in FIG. 1 is a giro cheque 1 which is formed by a sheet of paper to which a colour printing is applied. The colour printing is of course designed and executed such that imitation thereof is made as difficult as possible. This printing is otherwise the same for all giro cheques.

Further applied to the giro cheque is a personalized printing which is formed by name, postal code, home address and giro number of the user of the giro cheques, while the giro cheque can also be provided with an individual serial number. Some of this personal information can be printed on the giro cheque in different ways; generally the bottom white strip 3 of the giro cheque is thus generally provided once again with the giro number of the user.

Up to this point the described giro cheques correspond with the giro cheques in general use at the present.

According to the present invention the giro cheques are however provided with a perforation 4 which is formed in the present embodiment by the giro number. It is of course possible to use other data, such as a postal code or the name of the user.

It is however not per se essential to the invention for personalized data to be used for the perforation according to the invention; it is equally possible to apply a general perforation, for instance in the form of a symbol or pattern.

It is noted herein that the advantage of the invention lies particularly in the poor forgery potential of a paper representing value according to the invention; the perforation is chosen such that it can only be applied with laser equipment; for example through the choice of dimensions, sharp bends and the like the perforation is chosen such that it cannot be applied by mechanical means. This means that the potential forger would have to have laser equipment at his disposal, which would entail large investment in terms of finance and technological expertise.

Figure 2:
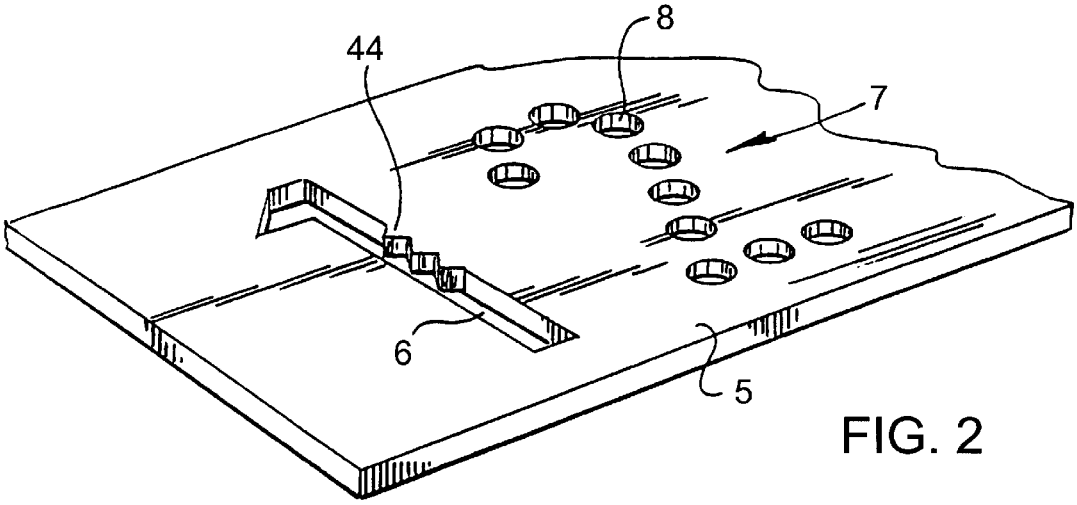
FIG. 2 shows an enlarged part view of a paper representing value, for instance a credit card, provided with a perforation according to the present invention.

It will be apparent that different types of perforation can be applied. FIG. 2 thus shows a paper representing value 5 in which a perforation 6 is applied in the form of a continuous number 1, and a perforation 7 in the form of separate circles 8. The points 8 are herein selected for instance such that they are precisely round and this roundness is clearly visible to the naked eye.

The use of laser beams enables addition of additional information, for instance in the form of a wave-like boundary line 44 of the perforation. This wave line, which is not visible to the naked eye, can contain personalized information which may be useful for instance in solving criminal offenses.

Figure 3:
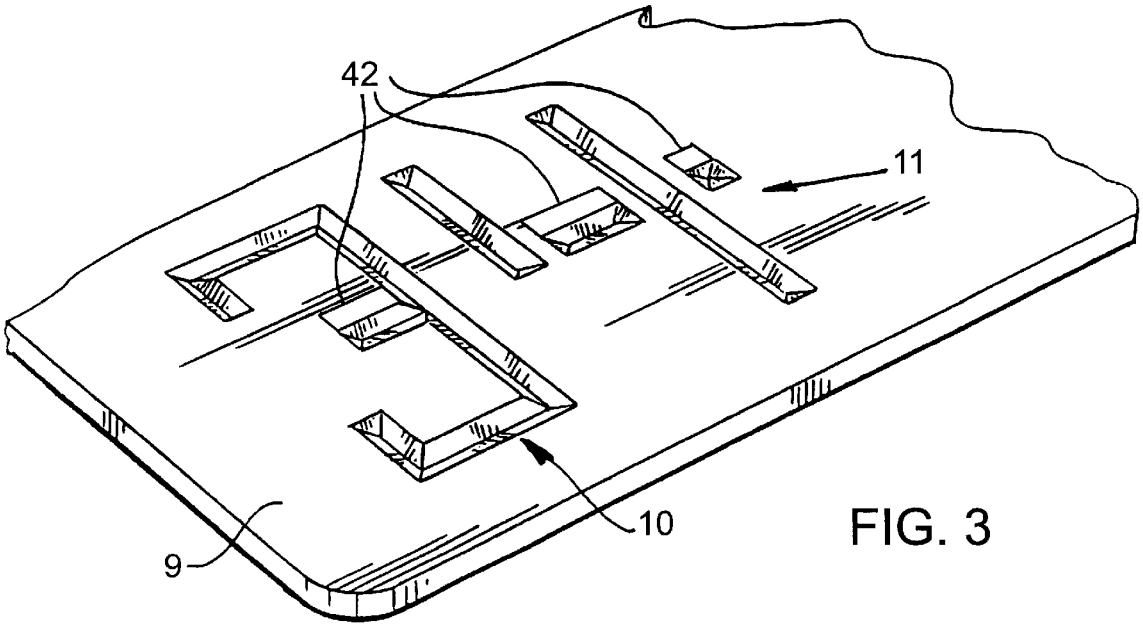
FIG. 3 shows a paper representing value, for instance a credit card, provided with a channel according to the invention applied by a laser beam.

FIG. 3 thus shows a credit card 9 in which a numeral three 10 is arranged by applying a V-shaped channel in the material in the form of the numeral three. The laser beam has an intensity herein such that the material is not perforated but wherein only a channel is arranged. A numeral four 11 consisting of separate elements is applied in similar manner. Additional information can also be added here, for instance in the form of local, fine patterns.

In this embodiment blackened spots 42 are further applied adjoining the recessed grooves. In order to apply the blackened spots 42 laser light is used with a still smaller intensity. It is otherwise also possible to locally pretreat the card 9, for instance with the printing press, to obtain the desired colouring, in this case blackening.

According to a preferred embodiment the carriers representing value are stacked in row and subsequently for each stack the patterns are applied on the carriers representing value. Of course, the carriers representing value will each be provided with substantially the same pattern. This embodiment is for instance suitable for giro cheques or for bank cheques, which can on this way each be provided of the account number of the client. Of course, it is not possible to provide an individualizing pattern within the stack in the same process. It is noted, that by the fact, that a laser beam is never completely parallel, the pattern of the upper carrier representing value within the stack will be wider than the pattern of the lowest carrier representing value within the stack. It speaks for itself, that the patterns are provided by the removal of material. From the stack a V-shaped amount of material is taken away. As a consequence thereof a rate of individualizing develops within each stack; as stated, more material has been taken away from the upper carrier representing value than from the lowest carrier representing value.

This configuration in which a stack of carriers representing value is provided of a pattern simultaneously is, however, only applicable when the carrier representing value is thin enough.

It is possible prior to performing the treatment by the laser beam to subject the substrate of the carrier, thus for instance the paper, to a pretreatment whereby the substrate becomes sensitive to laser light with the intensity for applying the desired patterns. After these patterns have been applied the desired sensitivity can be terminated by a suitable treatment. It is also possible that the sensitivity to laser light only lasts for a determined period. In addition, the substrate can already be made sensitive to laser light during production and this sensitivity terminated again after application of the patterns.

As noted, the invention relates also to carriers representing value in the form of credit card like cards. In this instance the perforation is applicable, for instance with patterns which cannot be or only with the greatest difficulties be provided of otherwise, for instance mechanically, for instance characters.

Figure 4:
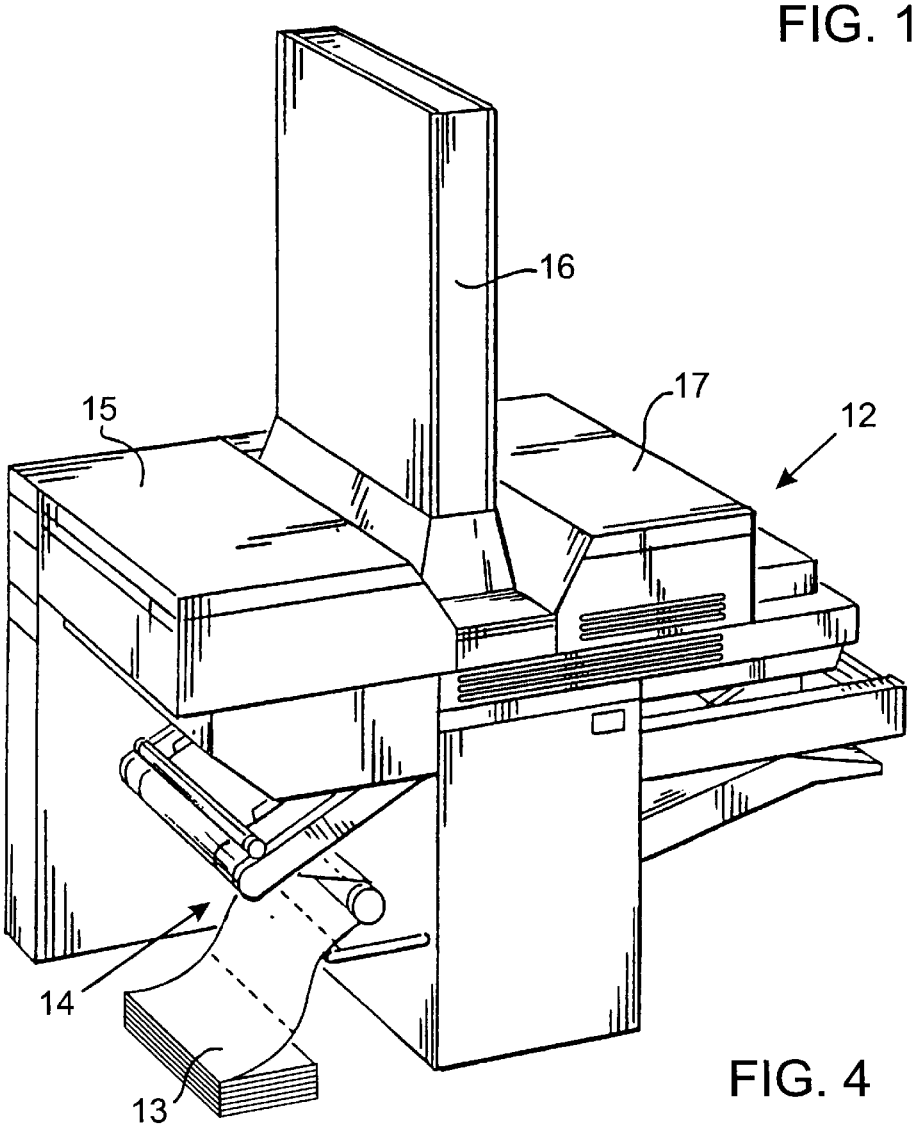
FIG. 4 is a schematic perspective view of a combination of a printing apparatus and a laser perforation device according to the present invention.

Depicted in FIG. 4 is printing apparatus 12 used for printing giro cheques with personalized data. The printing apparatus otherwise forms part of the prior art and is described here only insofar as is necessary to elucidate the present invention. The giro cheques are supplied in the form of zigzag-stacked continuous paper 13 which is fed to the printing apparatus 14 by means of a tensioning device. In the printing apparatus 12 the continuous paper 13 is transported over a substantially horizontally extending path not shown in the drawing, wherein it is printed with the personalized data by a printing device 15, it then passes through the laser device 16 according to the present invention, thereafter undergoes in a device 17 a finishing treatment forming part of the printing process, whereafter it emerges at the rear of the printing apparatus 12. The whole printing apparatus according to the present embodiment is adapted to simultaneously print and treat two giro cheques fed in the form of the double array of continuous paper 13.

Figure 5:
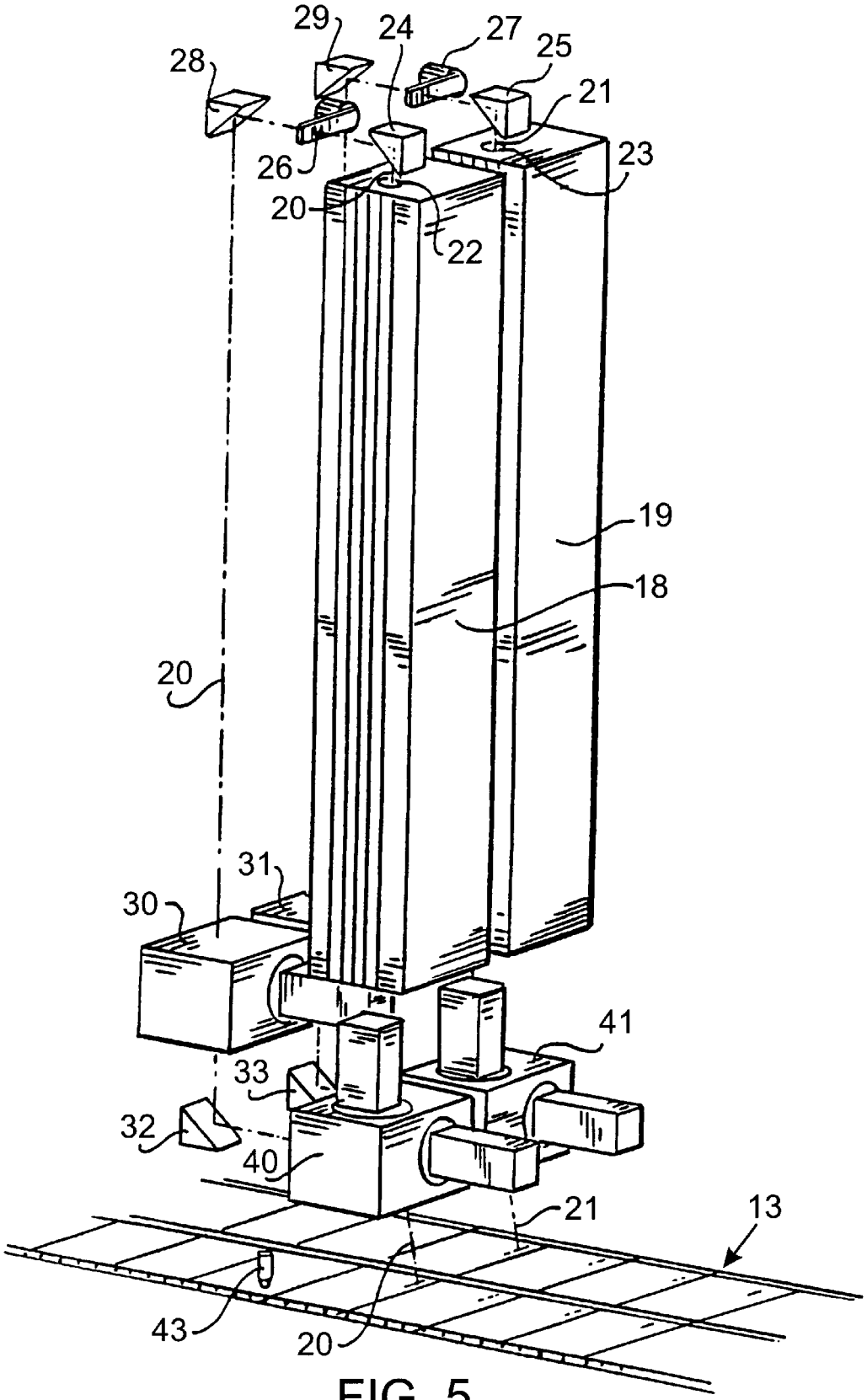
FIG. 5 is a perspective view of the most important components of a laser perforation device according to the invention.

The construction of the laser device is shown in more detail in FIG. 5. As can be seen in FIG. 5, the laser device 2 comprises laser sources 18,19 which are both disposed such that at the top the laser beam 20,21 exits through an exit aperture 22 respectively 23. This arrangement is chosen to enable accommodation of the laser device in the available space. The laser beams 20,21 are then reflected by means of a mirror 24,25 and deflected at an angle of 90°, they pass through a shutter 26 respectively 27 and are subsequently deflected downward by mirrors 28,29.

The parallel laser beams 20 respectively 21 then pass through a focussing device 30 respectively 31 whereby focussing of the relevant laser beams takes place. The laser beams then pass to a mirror 32 respectively 33 whereby they are deflected and fed to the deflecting devices 40 respectively 41. In the deflecting devices 40,41 the laser beams 20,21 are carried to the relevant location on the continuous paper 13 where they perform the operation according to the invention.

The device further comprises a detector 43 which responds to reference marks arranged on the continuous paper for generating a synchronization signal for the purpose of synchronizing the control of the laser beams with the movement of the continuous paper. This is particularly important when the transport speed of the continuous paper is not constant.

Figure 6:
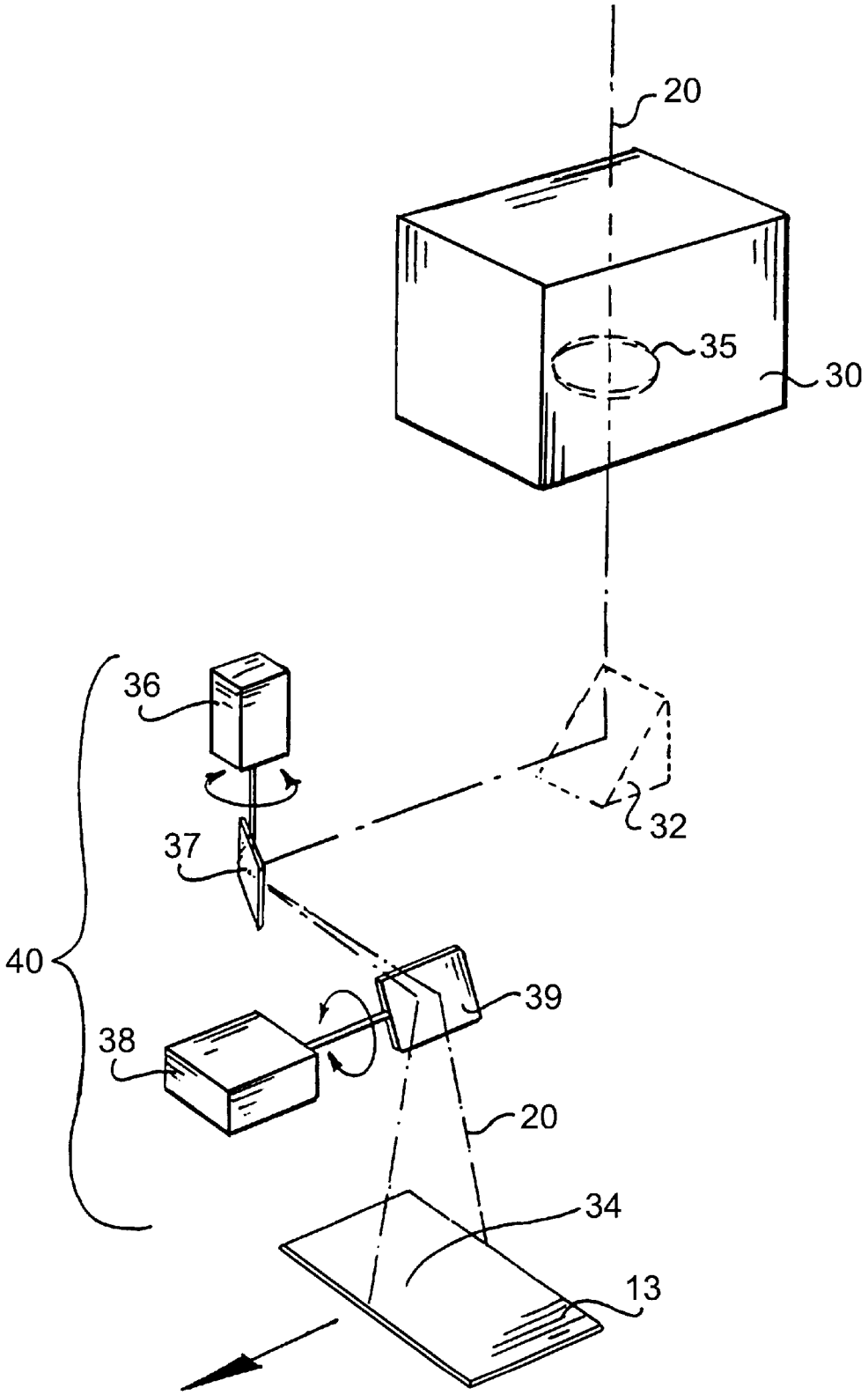
FIG. 6 is a schematic perspective view of the components of the device shown in FIG. 5 for controlling the laser beam.

The operation will now be elucidated with reference to FIG. 6. Arranged in the focussing device 30 is a lens which focuses the parallel laser beam coming from the laser light source 18 on the position 34 where the laser beam 20 contacts the continuous paper for perforating. Means are herein provided for moving the lens 35 upward or downward to always keep constant the optical distance between lens 35 and the contact position 34, and thus keep the laser beam focussed on the contact position 34. The location of the contact position 34 is in any case always changing.

The deflecting device 40 is formed by a first galvanometer 36 which is connected to a mirror 37 with which the location of the contact position 34 can be moved in the direction of movement of the continuous paper 13, and a second galvanometer 38 which is connected to a mirror 39 with which the location of the contact position 34 can be moved in transverse direction of the direction of movement of the continuous paper 13.

It will be apparent that with the thus shown device any random pattern can be applied to the continuous paper by means of perforation. The intensity modulation of the relevant laser beam 20 respectively 21 must of course take place herein in order to be able to jump from the one figure to the other.

According to another preferred embodiment the same pattern is more than once, for instance twice, applied on the same carrier representing value, in which the patterns are relatively slightly shifted. This is for instance attractive, when a wide pattern has to be applied. This configuration also applies when stacks of carriers representing value are formed, and the energy of a single laser beam is not sufficient for removing the material of the whole stack.

The entire beam manipulation can otherwise be performed by the units 30,40 and the intensity modulation such that the perforation operation takes place during the movement of the continuous paper. It is herein assumed in the first instance that the movement takes place uniformly. When it is anticipated that the movement will not take place uniformly, for instance as a result of the foregoing, the control can be adapted subject to the speed. Means must then of course be provided for measuring the speed of the paper to be used.

It will be apparent that the above described device can not only be used for perforating or for applying channels or other markings in paper, but also, albeit with the necessary modifications, for applying such markings on other materials, for instance plastic in the case of credit cards and/or credit card-like carriers representing value, or metal in the case of coins.

We claim:

1. A carrier representing value, comprising:

an identifying mark in said carrier, said identifying mark discernible with the naked eye; and a laser perforated pattern comprising first and second features, said first feature being a symbol discernible with the naked eye and said second feature forming a portion of said first feature formed so small that said second feature cannot be seen with the naked eye; and said symbol resembling said identifying mark.

2. A method for forming markings on a carrier representing value, comprising the steps of:

printing a pattern on the carrier to provide a printed pattern; and perforating the carrier to provide a perforated pattern resembling the printed pattern; the perforated pattern having first and second features, the first feature being a predefined shape sufficiently large in size that the predefined shape is discernible with a human eye, said second feature being a variation on the predefined shape and being of such a small size, that the second feature is not discernible by a human eye, thereby rendering the carrier difficult to forge as the second feature is not discernible by a human eye making exact duplication unlikely to protect against forgery, and making forgery easily detectable by comparing the perforated pattern with a perforated pattern on a forged carrier which lacks the second feature.

3. A method as in claim 2, further comprising:

selecting a material for said carrier;

said step of generating including stacking at least two carriers and directing a laser at said carriers, said laser of sufficient power to create holes in all of said at least two carriers and said carriers and said power and said material for said carrier being such that a one of said at least two closest to said laser has a slightly different hole size than a second of said at least two, whereby first and second ones of said at least two are distinguishable.

4. A method for creating a fraud prevention device in a value-representing carrier, comprising the steps of:

generating a pattern in the carrier to provide a generated pattern of a size such that the generated pattern is discernible with the naked eye; and perforating the carrier with a perforated pattern resembling the generated pattern, the perforated pattern including identifiable features of such a small size that said identifiable features cannot be discerned with the naked eye to protect against forgery of said carrier.

5. A method as in claim 4, wherein said step of generating includes modifying a portion of a piece of material of which said carrier is made using a laser.

6. A method as in claim 4, wherein said step of generating includes stacking multiple carriers and directing, toward the resulting stack, a laser, of such power that material of at least two of said multiple carriers are modified by interaction with said laser and such that respective symbols formed in a first and a second of said at least two are distinguishable.

7. A method as in claim 6, wherein said step of generating includes forming at least one aperture in said carrier.

8. A method as in claim 6, wherein said step of generating includes forming at least one depression in said carrier.

9. A carrier representing value having a printed pattern; and a perforated pattern comprising perforations arranged to resemble said printed pattern, each of said perforations having first and second features, said first feature being a predefined shape sufficiently large in size that said predefined shape is discernible with a human eye, said second feature being a variation on said predefined shape and being of such small size, that the second feature is not discernible by a human eye, thereby rendering said carrier difficult to forge as said second feature is not discernible by a human eye making duplication unlikely to protect against forgery, and making forgery easily detectable by comparing said perforated pattern with a perforated pattern on a forged carrier which lacks a second feature.

10. A carrier as in claim 9, wherein said first features represent at least one of numbers and letters.

11. A carrier as in claim 10, wherein said predefined shape is one of shapes other than shapes defining numbers and letters.

12. A carrier as in claim 10, wherein said first feature is at least one depression in said carrier and said second feature includes variations in depth of said at least one depression.

13. A carrier as in claim 10, wherein said first feature is at least one substantially round hole and said second feature is the preciseness of the roundness of said hole.

14. A carrier as in claim 10, wherein at least one of said first feature and said second feature is at least one depression in a surface of a primary plane of said carrier.

15. A carrier as in claim 10, wherein at least one of said first feature and said second feature is at least one aperture in said carrier.

16. A carrier as in claim 10, wherein at least one of said first feature and said second feature is at least one depression in a surface of a primary plane of said carrier and said second feature is a variation in a depth of said depression.

17. A carrier as in claim 10, wherein at least one of said first feature and said second feature is at least one aperture of a certain average width in said carrier and said second feature is a variation in said width.

18. A carrier as in claim 10, wherein at least one of said first and second features includes a coloring of a portion of said carrier that is distinct from a remainder of said carrier.

19. A carrier as in claim 9, wherein said predefined shape is one of shapes other than shapes defining numbers and letters.

20. A carrier as in claim 19, wherein said first feature is at least one depression in said carrier and said second feature includes variations in depth of said at least one depression.

21. A carrier as in claim 19, wherein said first feature is at least one substantially round hole and said second feature is the preciseness of the roundness of said hole.

22. A carrier as in claim 19, wherein at least one of said first feature and said second feature is at least one depression in a surface of a primary plane of said carrier.

23. A carrier as in claim 19, wherein at least one of said first feature and said second feature is at least one aperture in said carrier.

24. A carrier as in claim 19, wherein at least one of said first feature and said second feature is at least one depression in a surface of a primary plane of said carrier and said second feature is a variation in a depth of said depression.

25. A carrier as in claim 19, wherein at least one of said first feature and said second feature is at least one aperture of a certain average width in said carrier and said second feature is a variation in said width.

26. A carrier as in claim 19, wherein at least one of said first and second features includes a coloring of a portion of said carrier that is distinct from a remainder of said carrier.

27. A carrier as in claim 9, wherein said first feature is at least one depression in said carrier and said second feature includes variations in depth of said at least one depression.

28. A carrier as in claim 27, wherein said first feature is at least one substantially round hole and said second feature is the preciseness of the roundness of said hole.

29. (A carrier as in claim 27, wherein at least one of said first feature and said second feature is at least one depression in a surface of a primary plane of said carrier.

30. A carrier as in claim 27, wherein at least one of said first feature and said second feature is at least one aperture in said carrier.

31. A carrier as in claim 27, wherein at least one of said first feature and said second feature is at least one depression in a surface of a primary plane of said carrier and said second feature is a variation in a depth of said depression.

32. A carrier as in claim 27, wherein at least one of said first feature and said second feature is at least one aperture of a certain average width in said carrier and said second feature is a variation in said width.

33. A carrier as in claim 27, wherein at least one of said first and second features includes a coloring of a portion of said carrier that is distinct from a remainder of said carrier.

34. A carrier as in claim 9, wherein said first feature is at least one substantially round hole and said second feature is the preciseness of the roundness of said hole.

35. A carrier as in claim 34, wherein at least one of said first feature and said second feature is at least one depression in a surface of a primary plane of said carrier.

36. A carrier as in claim 34, wherein at least one of said first feature and said second feature is at least one aperture in said carrier.

37. A carrier as in claim 34, wherein at least one of said first feature and said second feature is at least one depression in a surface of a primary plane of said carrier and said second feature is a variation in a depth of said depression.

38. A carrier as in claim 34, wherein at least one of said first feature and said second feature is at least one aperture of a certain average width in said carrier and said second feature is a variation in said width.

39. A carrier as in claim 34, wherein at least one of said first and second features includes a coloring of a portion of said carrier that is distinct from a remainder of said carrier.

40. A carrier as in claim 9, wherein at least one of said first feature and said second feature is at least one depression in a surface of a primary plane of said carrier.

41. A carrier as in claim 40, wherein at least one of said first feature and said second feature is at least one aperture in said carrier.

42. A carrier as in claim 40, wherein at least one of said first feature and said second feature is at least one depression in a surface of a primary plane of said carrier and said second feature is a variation in a depth of said depression.

43. A carrier as in claim 40, wherein at least one of said first feature and said second feature is at least one aperture of a certain average width in said carrier and said second feature is a variation in said width.

44. A carrier as in claim 40, wherein at least one of said first and second features includes a coloring of a portion of said carrier that is distinct from a remainder of said carrier.

45. A carrier as in claim 9, wherein at least one of said first feature and said second feature is at least one aperture in said carrier.

46. A carrier as in claim 45, wherein at least one of said first feature and said second feature is at least one depression in a surface of a primary plane of said carrier and said second feature is a variation in a depth of said depression.

47. A carrier as in claim 45, wherein at least one of said first feature and said second feature is at least one aperture of a certain average width in said carrier and said second feature is a variation in said width.

48. A carrier as in claim 45, wherein at least one of said first and second features includes a coloring of a portion of said carrier that is distinct from a remainder of said carrier.

49. A carrier as in claim 9, wherein at least one of said first feature and said second feature is at least one depression in a surface of a primary plane of said carrier and said second feature is a variation in a depth of said depression.

50. A carrier as in claim 49, wherein at least one of said first feature and said second feature is at least one aperture of a certain average width in said carrier and said second feature is a variation in said width.

51. A carrier as in claim 49, wherein at least one of said first and second features includes a coloring of a portion of said carrier that is distinct from a remainder of said carrier.

52. A carrier as in claim 9, wherein at least one of said first feature and said second feature is at least one aperture of a certain average width in said carrier and said second feature is a variation in said width.

53. A carrier as in claim 52, wherein at least one of said first and second features includes a coloring of a portion of said carrier that is distinct from a remainder of said carrier.

54. A carrier as in claim 9, wherein at least one of said first and second features includes a coloring of a portion of said carrier that is distinct from a remainder of said carrier.

* * * * *